United States Patent [19]

Capoccia

[11] 4,042,046

[45] Aug. 16, 1977

[54] DIRECTIONAL CONTROL MECHANISM FOR UNDERGROUND DRIVEN PIPES AND CONDUITS

[75] Inventor: Anastasio Capoccia, Wixom, Mich.

[73] Assignee: The Richmond Manufacturing Company, Ashland, Ohio

[21] Appl. No.: 455,188

[22] Filed: Mar. 27, 1974

[51] Int. Cl.[2] ..... E21B 7/04

[52] U.S. Cl. ..... 175/73; 175/45; 175/61

[58] Field of Search ..... 175/73, 76, 61, 62, 175/45, 122

[56] References Cited

U.S. PATENT DOCUMENTS

| | | | |
|---|---|---|---|
| 3,326,008 | 6/1967 | Baran et al. | 175/73 X |
| 3,415,329 | 12/1968 | Marlind | 175/73 X |
| 3,465,834 | 9/1969 | Southworth | 175/73 X |
| 3,526,285 | 9/1970 | Adkins et al. | 175/73 |
| 3,587,756 | 6/1971 | Adkins et al. | 175/61 |
| 3,637,032 | 1/1972 | Jeter | 175/73 |
| 3,712,391 | 1/1973 | Coyne | 175/61 X |
| 3,743,034 | 7/1973 | Bradley | 175/73 X |
| 3,767,836 | 10/1973 | Geis et al. | 175/61 X |
| 3,794,128 | 2/1974 | Gagen et al. | 175/73 |
| 3,811,519 | 5/1974 | Driver | 175/73 |

*Primary Examiner*—Ernest R. Purser
*Attorney, Agent, or Firm*—Palmer Fultz

[57] ABSTRACT

A mechanism carried at the forward end of a tubular pipe which is adapted to be driven underground over a considerable distance while maintained at a particular grade level. In the preferred embodiment the control mechanism comprises a cylindrically shaped steering head pivotally mounted to the forward end of the pipe and including means attachable to the steering head for rotating the same a predetermined amount with respect to the direction of movement of the pipe so as to initiate a movement of the pipe in either vertical or horizontal directions. In another version of the present invention a second cylindrically shaped steering head is mounted at the forward end of the first steering head with the second steering head being movable about an axis which is perpendicular to the axis of rotation of the first head whereby the direction of movement of the pipe may be selectively controlled in perpendicular planes.

1 Claim, 11 Drawing Figures

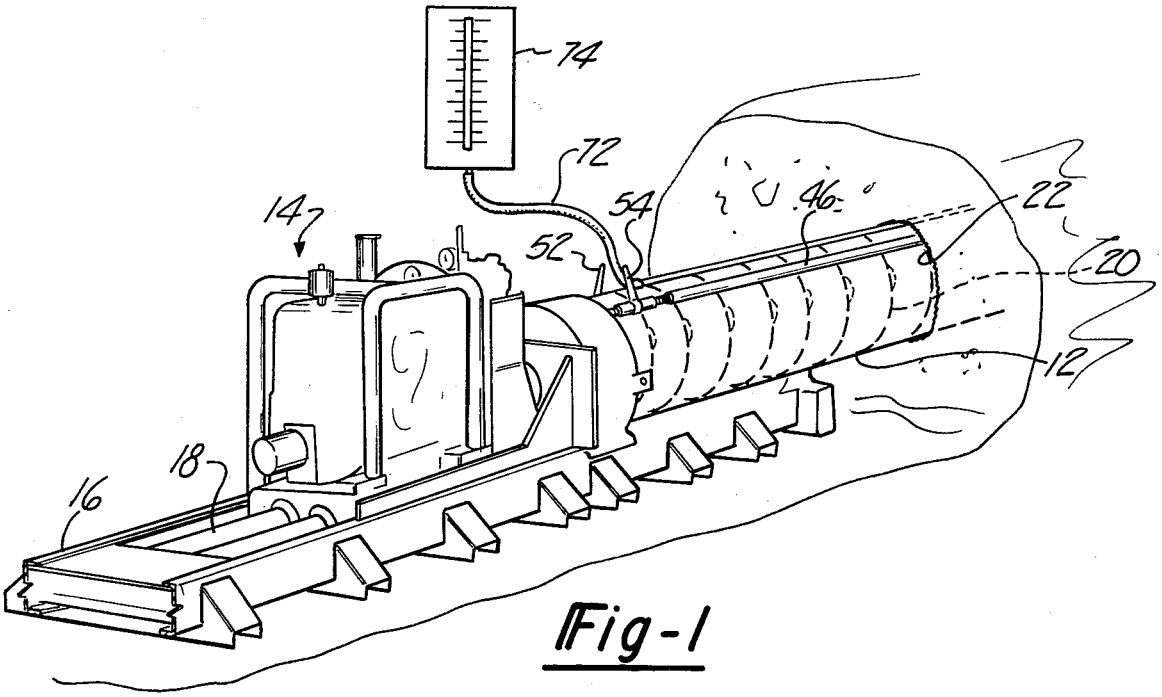
Fig-1
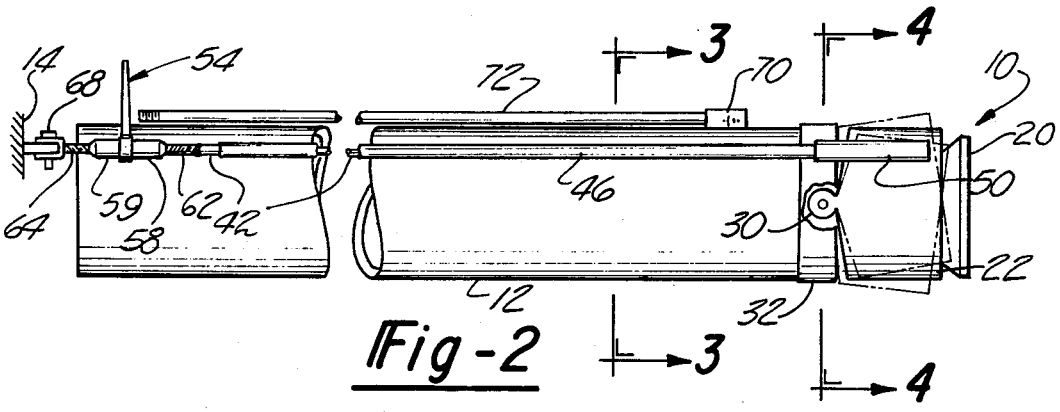
Fig-2
Fig-3
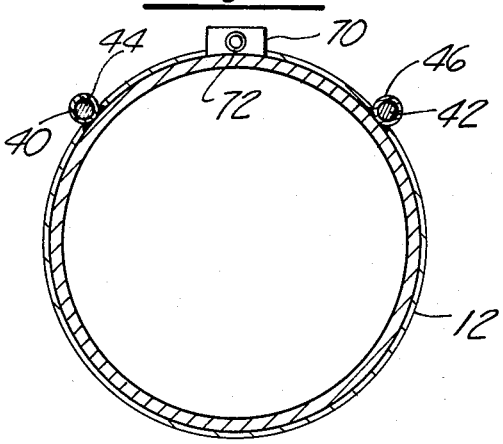
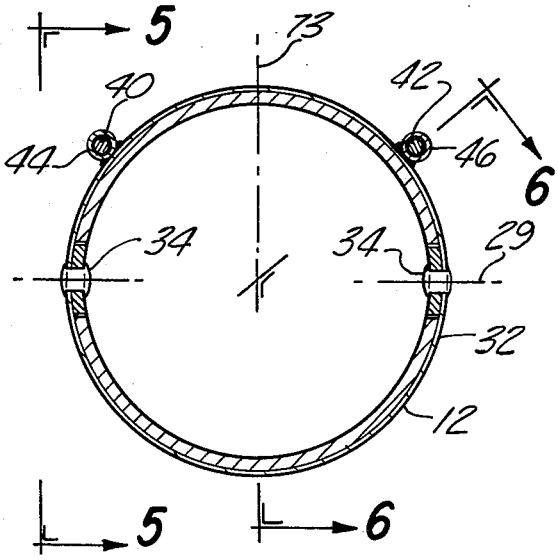
Fig-4

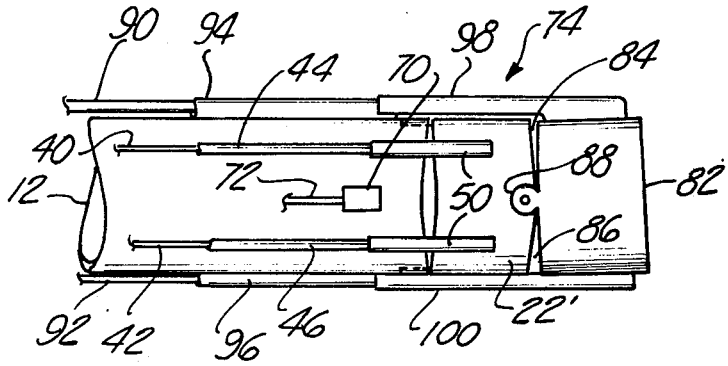
Fig-8
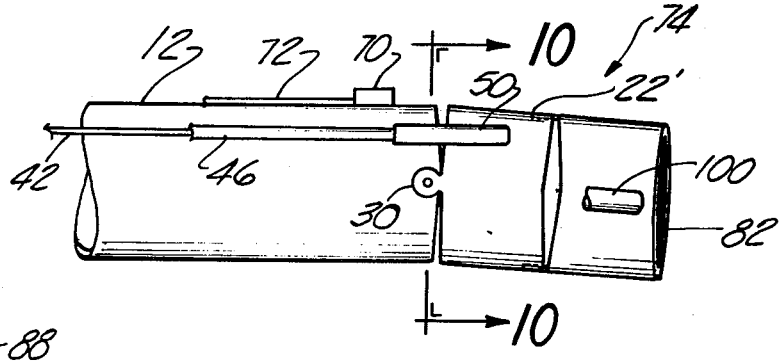
Fig-9
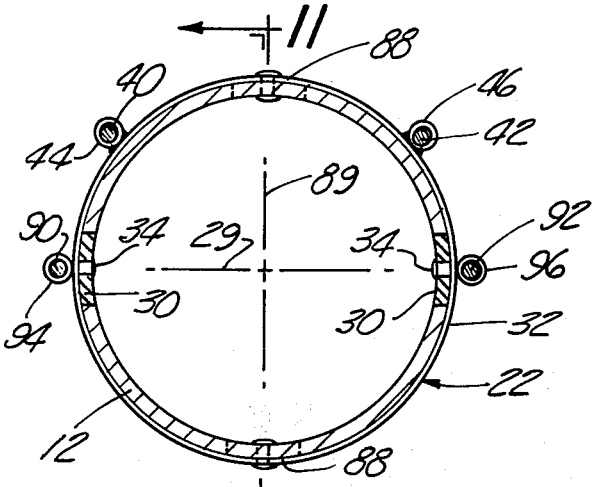
Fig-10
Fig-11
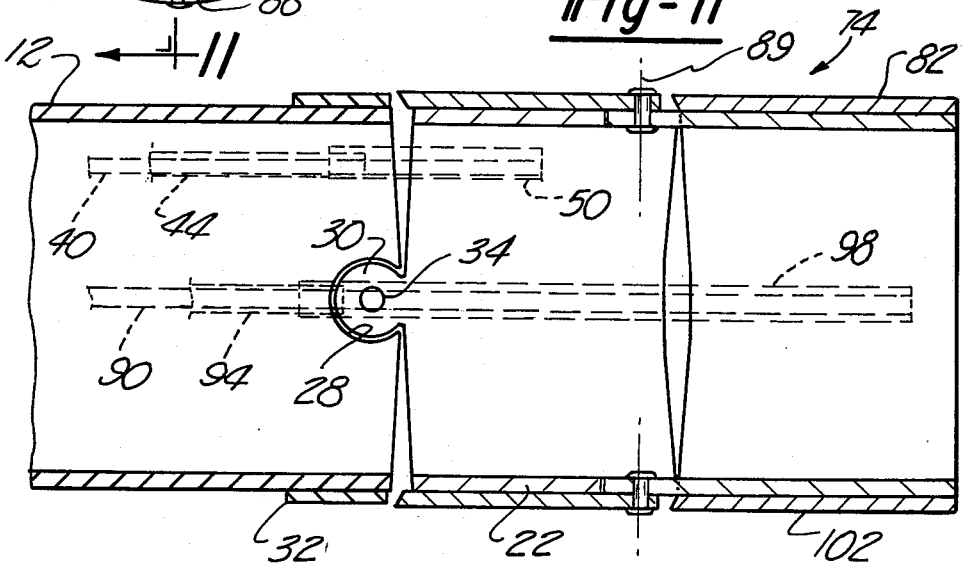

DIRECTIONAL CONTROL MECHANISM FOR UNDERGROUND DRIVEN PIPES AND CONDUITS

BACKGROUND OF THE INVENTION

I. Field of the Invention

The present invention relates to an improvement in mechanisms employed to drive conduits, pipes and the like through ground and, in particular, the present invention relates to a means for accurately controlling the direction of movement of such underground conduits and pipes.

II. Description of the Prior Art

Heretofore, in the laying of rigid conduits or pipes in the ground, it was customary to dig a trench a sufficient depth and length in which the conduit could be placed with the trenches subsequently being filled in after the conduit has been laid. This method of laying conduits and pipes has proved to be considerably expensive and as such, new methods and techniques have been employed and, in particular, devices have been developed for driving pipes underground which avoids the necessity of having to dig trenches corresponding in length to the pipe laid.

It is not uncommon for pipes to be driven several hundred feet underground. When such techniques are employed in the laying of pipe, it is extremely important that the grade or level of the pipe be maintained as accurately as is possible, as the pipe must exit from the ground at the desired point of connection with whatever other conduits are being employed. If a pipe driven through the ground which is not on the proper grade of level or emerges from the ground at a point too far removed from its desired point of exit, the pipe is unusable and results in substantial expense to the contractor as this pipe must be removed.

It would therefore be desirable to provide a means for controlling the direction of movement of such underground driven pipes.

SUMMARY OF THE INVENTION

The present invention which will be described subsequently in greater detail comprises a directional control mechanism attachable to the forward end of an underground driven pipe which facilitates the control of the movement of the pipe such that its direction in vertical and horizontal planes may be easily and simply controlled whereby the pipe may be maintained on a predetermined course or path.

It is therefore an object of the present invention to provide a mechanism for controlling the direction and movement of an underground driven pipe.

It is a further object of the present invention to provide such a directional control mechanism which is extremely simple in its design, construction and use and one which can be reused, and thus, one which is extremely economical.

Other objects, advantages and applications of the present invention will become apparent to those skilled in the art of driving pipes underground when the accompanying description of several examples of the best modes contemplated for practicing the invention are read in conjunction with the accompanying drawings.

BRIEF DESCRIPTION OF THE DRAWINGS

The description makes reference to the accompanying drawings wherein like reference numerals refer to like components throughout the several views, and in which:

FIG. 1 is a perspective view of an earth boring machine used in the process of driving a pipe underground;

FIG. 2 is a fragmentary side elevational view of a pipe having incorporated thereon a directional control mechanism for controlling the direction of movement of the pipe illustrated in FIG. 2 as the same is being driven underground by the boring machine illustrated in FIG. 1;

FIG. 3 is a fragmentary cross sectional view taken along line 3—3 of FIG. 2;

FIG. 4 is a fragmentary cross sectional view taken along line 4—4 of FIG. 2;

FIG. 8 is a top elevational view of a modification of the directional control mechanism illustrated in FIG. 2;

FIG. 9 is a side elevational view of the pipe and directional control mechanism illustrated in FIG. 8;

FIG. 10 is a cross sectional view of the directional control mechanism taken along line 10—10 of FIG. 9; and FIG. 11 is a fragmentary longitudinal cross sectional view of the directional control mechanism taken along line 11—11 of FIG. 10.

DESCRIPTION OF THE PREFERRED EMBODIMENTS

Figure 5:
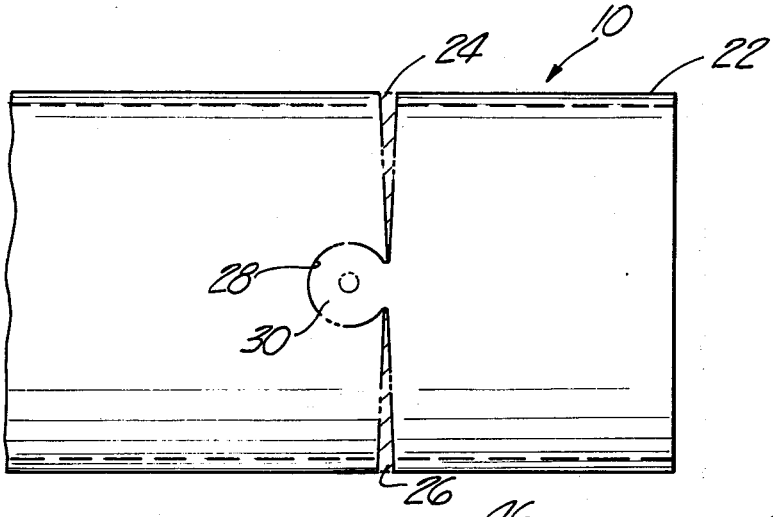
FIG. 5 is a fragmentary side elevational view as seen from line 5—5 of FIG. 4.

Referring now to the drawings and, in particular, to FIGS. 1 and 2 wherein there is illustrated one example of the present invention in the form of a directional control mechanism 10 mounted to the forward edge of a pipe 12 which, in turn, is driven underground by means of a boring machine 14. The boring machine 14 is conventional in its construction and is slidably mounted on a track 16 in such a manner that it may be shifted longitudinally along the track 16 by means of a hydraulic piston assembly 18. The forward end of the boring machine 14 rotatably mounts an auger 20 which is rotatably mounted within the interior of the pipe 12 with the forward end of the auger 20 engaging and boring a hole 22 within the ground. As the auger 20 bores the hole 22 and carries the dirt outwardly for ejection by the boring machine 14, the hydraulic pistons 18 exert a force on the boring machine 14 so as to drive the pipe 12 into the ground. The type of boring machine 14 is normally utilized to lay underground piping without the necessity of excavating the ground. As aforementioned, it is necessary to drive such pipes a considerable distance from 10 to over 200 feet with the pipe 12 exiting at a predetermined location which must be rather accurately controlled. To this end, the forward end of the pipe 12 is provided with the directional control mechanism 10. The boring machine 14, the track 16 and the auger 20 are all conventional in their construction and since they are commercially available a further description of these components of the system need not be described in any further detail.

As can best be seen in FIG. 5 the leading edge of the pipe 12 is modified to form a steering head 22 of the directional control mechanism 10. This is accomplished by cutting the pipe 12 at a location approximately 12 to 18 inches inwardly from its forward edge to remove two pie shaped annular sections 24 and 26 while performing a circular cut 28 forming a pair of opposed circular flanges 30 which are pivotally movable within the circular cut 28 whereby the steering head 22 is rotatable about an axis 29 (FIG. 4) defined by the flanges 30. The steering head 22 may be pivoted about the axis 29 an arcuate distance of approximately 1 inch on either side of the horizontal.

Figure 6:
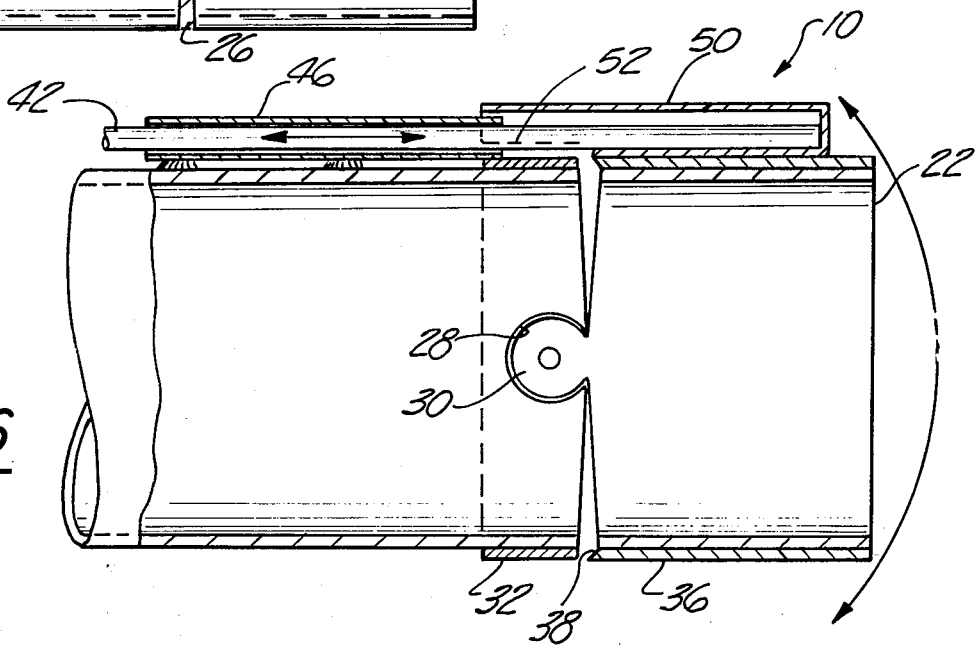
FIG. 6 is a fragmentary cross sectional view taken along the line 6—6 of FIG. 4.

In order to insure that the steering head 22 remains within the circular cut 28, and thus, properly alignable with the pipe 12, the circular flanges 30 are mounted to a retainer ring 32. As can best be seen in FIGS. 4 and 6, the retainer ring 32 is mounted to the outer peripheral surface of the pipe 12 adjacent the aforementioned pie shaped cuts 24 and 26 and is secured thereto by any suitable means such as by welding. The diametrically opposed circular flanges 30 are pivotally attached to the retainer ring 32 by pintle bearings 34 (FIG. 4) which extend axially through the flanges 30 and the retainer 32. The pintle bearings 34 are secured to the flanges 30 and the retainer ring 32 in any suitable manner sufficient to permit the steering head 22 to pivot about the axis 29 such that the head 22 may be raised and lowered with respect to the horizontal upon suitable actuation in a manner to be described in greater detail hereinafter.

The steering head 22 is provided with a metal shroud 36, the inner edge 38 (FIG. 6) of which is chamfered and extends outwardly beyond the pie shaped edge of the steering head 22 so as to provide a means for partially enclosing the pie shaped openings to prevent dirt from entering the same while permitting a predetermined clearance such that the steering head 22 may be pivoted with respect to the leading edges of the retainer ring 32.

Actuation of the steering head 22 is accomplished by means of a pair of control rods 40 and 42 mounted at arcuately spaced locations on the outer periphery of the pipe 12. As can best be seen in FIGS. 3, 4 and 6 the control rods 40 and 42 are, respectively, slidably mounted for reciprocal motion within control rod protective tubes 44 and 46, the latter set of tubes being welded to the outer periphery of the pipe 12 so as to securely mount the control rods 40 and 42 to the pipe 12. As can best be seen in FIGS. 2, 6 and 8, the steering head 22 is provided with a pair of arcuately spaced tubular members 50 which are axially alignable with the control rod tubes 44 and 46. The tubular members 50 are enclosed at their extended ends to prevent the entry of dirt within the tubular members 50 while the forward end receives the leading edge of the tubes 44 and 46. The underside of each tubular member 50 has an undercut at 52 (FIG, 6) to permit the steering head 22 to be rotated without interference with the leading edge of the protective control rod tubes 44 and 46. The forward edge of the control rods 40 and 42 extend through their respective protective control rod tubes 44 and 46 and into the interior of the tubular members 50 whereupon the extended ends of the control rods 40 and 42 are welded to the interior of the tubular members 50 which, as aforementioned, are welded to the protective shroud 36 on the steering head 22. It can thus be seen that when the rods 40 and 42 re moved forwardly within their protective coverings, that is toward the steering head 22, a force will be exerted upon the steering head 22 to rotate the same downwardly, that is, clockwise as viewed in FIG. 6. Similarly, when the control rods 40 and 42 are reciprocated rearwardly, that is toward the boring machine 14, a force will be exerted upon the steering head 22 to rotate the same upwardly, that is, in a counter-clockwise direction as viewed in FIG. 6.

This reciprocal actuation of the rods 40 and 42 is accomplished by means of ratchet assemblies 52 and 54 which are respectively connected to the control rods 40 and 42. An enlarged view of the control ratchet assembly 54 is illustrated in FIG. 7 and the following description of the control ratchet assembly 54 is equally applicable to the control rod ratchet assembly 52 as the components are identical, and thus, the ratchet assembly 52 need not be described in further detail.

Figure 7:
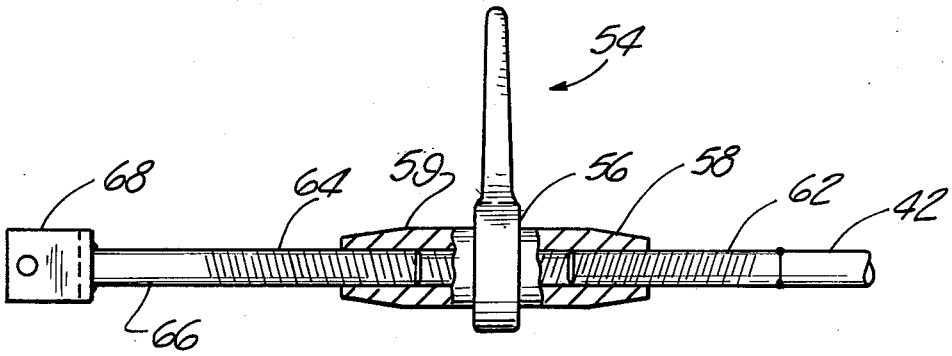
FIG. 7 is an enlarged fragmentary view of a portion of the directional control mechanism illustrated in FIG. 2.

As can best be seen in FIG. 7 the ratchet assembly 54 comprises a lever operated ratchet 56 attached in the conventional manner to threaded members 58 and 59 which, in turn, threadedly and reciprocally engage (on opposite sides of the lever actuated ratch 56) threaded stems 62 and 64 formed on the outermost ends of the control rod 42 and a stabilizing rod 66, respectively. The stabilizing rod 66 is attached by a suitable coupling 68 to the forward portion of the boring machine 14. It can be seen that as the lever actuated ratchet 56 is selectively rotated in opposite directions, the threaded portion 58 and 59 will rotate relative to the threaded stems 62 and 64. Since these stems are restrained from rotation, they will reciprocate with respect to the threaded portions 58 and 59 such as to axially shift the rod 42 in opposite directions along the length of the pipe 12 to selectively position the steering head 22 about the axis 29 of the pintles 34 to control the inclination of the steering head 22 with respect to the longitudinal axis of the pipe 12, and thus, control the direction of movement of the pipe 12 as the same is driven into the ground bore 22 by the boring machine 14.

As can best be seen in FIGS. 1, 2 and 3 the top portion of the pipe 12 carries a water sensing level head 70 which is connected by a water tube 72 to a water level gauge 74. The device which is conventional in its construction is utilized to sense whether the pipe 12 is moving along at a certain desired level such that the pipe 12 will emerge at a desired location. If during the boring process as the boring machine 14 removes earth by means of the auger 20 and drives the pipe 12 into the earth by means of the hydraulic piston mechanism 18, the direction of movement of the pipe 12 is not in accordance with the desired path, the ratchet assemblies 52 and 54 may be rotated either inwardly or outwardly to reciprocate the control rods 40 and 42 in the aforementioned manner and thereby rotate the steering head 22 about the pintle axis 29 whereby the direction of movement of the pipe 12 may be varied, that is, the direction may be caused to change in an upward or downwardly manner depending upon how the steering head 22 is rotated. In addition, by rotating the ratchet assemblies 52 and 54 in opposite directions at the same time, the steering head 22 may be rotated in an opposite plane, that is, about an axis 73 (FIG. 4) perpendicular to the axis 29 of the pintles 34 so that the direction of movement of the pipe 12 may be varied about the horizontal.

It can thus be seen that the present invention provides a means for controlling the direction of a pipe 12 being driven underground such that the direction of the pipe 12 may be varied in both horizontal and vertical planes. It should also be understood that after the pipe which normally comes in 12 foot or larger sections has been driven within the ground, it is separated from the forward ends of the boring machine 14 and new sections of both pipe, auger and control rods are attached to the boring machine and to the pipe, auger and control rods previously driven into the ground, whereby the operation may commence and a new section of pipe driven into the ground.

Referring now to FIGS. 8 through 11 of the drawings for a description of a second embodiment of the present invention in the form of a directional control mechanism 74 attached to the forward end of the pipe 12. The mechanism 10 comprises steering head 22' which is attached to the forward edge of the pipe 12 in the aforementioned manner and which structure 22' is identical in both its construction and operation to the aforementioned steering head 22, but which is modified to the extent that a second steering head 82 is attached to the leading face of the steering head 22'. Since the steering head 22' is identical to the aforementioned steering head 22, the components of the steering head 22' will be described by the same numbers as the components of the steering head 22.

The second steering head 82 which is formed from the steering head 22' in that pie shaped sections 84 and 86 (FIG.8) are removed from the steering head 22' while a pair of diametrically opposed circular flanges 88 are formed in the same manner as the circular flanges 30 are formed on the forward end of the pipe 12. The pie shaped sections are 90' removed from the pie shaped sections 24 and 26, and thus, the flanges 88 are mounted to the forward face of the steering head 22' at locations that are 90° displaced from the locations about which the flanges 30 rotate and thus, the head 82 may be rotated about an axis 89 which is perpendicular to the axis 29 of the head 22'. It can thus be seen that through proper actuation by a control mechanism that will be described hereinafter, the steering head 82 may be rotated about the vertical axis 89 such that the direction of movement of the pipe 12 may be varied in a horizontal direction, while the rotation of the steering head 22' about a horizontal axis 29 permits the control of the direction of movement of the pipe 12 in a vertical direction.

The directional control mechanism 74 is controlled in a manner that is similar to the control of the aforementioned mechanism 10 described in respect to the embodiments illustrated in FIGS. 1 through 7. As can best be seen in FIGS. 8 and 10, the control mechanism comprises a pair of control rods 90 and 92 that are mounted on diametrically opposing sides of the pipe 12 and which are, respectively, enclosed in protective control rod tubes 94 and 96 that extend the full length of the pipe 12. The tube 94 and 96 terminate in tubular members 98 and 100 are carried at diametrically opposed locations on a shroud 102 (FIG, 11) which protects the steering head 82 and which shroud 102 is similar in structure to the shroud 36 covering the steering head 22. The control rods 90 and 92, respectively, extend through the tubular members 98 and 100 and are attached to the steering head 82 by welding or the like such that when the rods 90 and 92 are reciprocated within their respective protective coverings 94 and 96, the steering head 82 may be rotated about the circular flanges 88, that is, when the rod 90 is moved toward the boring machine 14 and rod 92 is moved toward the steering head 82, the head 82 will be rotated, leftwardly about the axis 89, that is, in a counter-clockwise direction as viewed in FIG. 8. Similarly, when the rod 90 is reciprocated in an opposite direction, that is, towards the steering heads 22' and 82 and the rod 92 is moved back towards the boring machine 14, the steering head 82 will be rotated in a opposite direction about vertical axis 89, that is, downwardly as viewed in FIG. 8 so as to turn the machine steering head 82 in a rightwardly direction. By proper manipulation of the control rods 90 and 92 by any suitable means such as by means of the ratchet assembly 54 shown in FIG. 7, the steering head 82 may be turned to the left or right to guide the pipe 12 to the left or to the right while the up and down movement of the pipe 12 may be controlled by the steering head 22'.

In a similar manner as aforementioned the rods 90 and 92 as well as the cover tubes 94 and 96 are increased in length as new pipe 12 is added between the originally driven pipe and the boring machine 14.

After the boring machine 14 has driven the pipe 12 the desired length and the pipe 12 is in its proper location, the steering heads may be removed by any suitable means and the pipe driven the last few feet to complete its full length. Control rods 90 and 92, the control rod 40 and 42 and the other accessories such as the water gauge and the ratchet assemblies may be removed from the pipe for reuse on new application.

Although the directional control mechanism 74 is illustrated with steering head 82 being carried by the forward edge of the steering head 22', it should be understood that in those applications wherein the grade of the pipe 12 is controlling, the directional control mechanism 74 is modified such that the steering head 82 is carried at the end of the pipe 12 and the steering head 22' is carried at the forward end of the head 82. With the steering head 22' at the front of the mechanism 74, the up and down movement of the pipe 12 can be more easily controlled since the steering head 22' will be used more often in this position as under the aforementioned circumstances.

It can thus be seen the present invention has disclosed a new and improved means for controlling the direction and movement of a pipe which is being laid underground by a impact type boring machine.

Although two forms of the present invention have been disclosed, other forms may be had, all coming within the spirit of the invention and scope of the appended claims.

What is claimed is as follows:

1. A mechanism for controlling the direction of movement of a pipe being driven underground generally along a horizontal path, and wherein a mechanical device is employed at the rear end of the pipe to forcibly drive the pipe along the path, said mechanism comprising: a pipe; an auger means mounted coaxially within the pipe for removing earth in the path of the movement of the pipe; a cylindrical head pivotally mounted to the forward end of the pipe, said cylindrical head being pivotable independently of said auger means; control means for inclining said cylindrical head with respect to the longitudinal axis of said pipe, the movement of said cylindrical head being inclined independently with respect to said auger means; a second cylindrical head pivotally carried by the forward end of said first mentioned cylindrical head for pivotal movement in a direction transverse to the direction of pivotal movement of said first mentioned cylindrical head and independently of said first mentioned cylindrical head to control the direction and movement of said pipe independently of said first head; second control means carried by said second head and extendable rearwardly of said pipe; and means for moving said second control means axially with respect to the longitudinal axis of said pipe for controlling the amount of inclination of said second cylindrical head with respect to said pipe axis.

* * * * *